US006951238B2

(12) United States Patent
Hirai et al.

(10) Patent No.: US 6,951,238 B2
(45) Date of Patent: Oct. 4, 2005

(54) VERTICAL INJECTION MACHINE USING GRAVITY FEED

(75) Inventors: Kinji Hirai, Kanagawa (JP); Hisayuki Fukada, Shizuoka (JP); Yuuji Osada, Kanagawa (JP)

(73) Assignee: Takata Corporation, Tokyo (JP)

( * ) Notice: Subject to any disclaimer, the term of this patent is extended or adjusted under 35 U.S.C. 154(b) by 4 days.

(21) Appl. No.: 10/440,400

(22) Filed: May 19, 2003

(65) Prior Publication Data

US 2004/0231819 A1 Nov. 25, 2004

(51) Int. Cl.[7] ..... B22D 11/04
(52) U.S. Cl. ..... 164/312; 164/335
(58) Field of Search ..... 164/113, 312, 164/900, 336, 335

(56) References Cited

U.S. PATENT DOCUMENTS

| | | | |
|---|---|---|---|
| 2,386,966 | A | 10/1945 | MacMillin |
| 2,505,540 | A | 4/1950 | Goldhard |
| 2,529,146 | A | 11/1950 | Feitl |
| 2,785,448 | A | 3/1957 | Hodler |

(Continued)

FOREIGN PATENT DOCUMENTS

| | | | |
|---|---|---|---|
| DE | 196 11 419 | | 9/1996 |
| EP | 153528 | | 3/1991 |
| EP | 0 476 843 | | 3/1992 |
| EP | 0 761 344 | | 3/1997 |
| EP | 1 038 614 | A1 | 9/2000 |
| FR | 1.447.606 | | 11/1996 |
| JP | 59-152826 | | 8/1984 |
| JP | 1-166874 | | 6/1989 |
| JP | 1-178345 | | 7/1989 |
| JP | 1-192447 | | 8/1989 |
| JP | 2-202420 | | 8/1990 |
| JP | 5-8016 | | 1/1993 |
| JP | 5-8017 | | 1/1993 |
| JP | 2-274360 | | 1/1993 |
| JP | 5-285626 | | 11/1993 |
| JP | 5-285627 | | 11/1993 |
| JP | 6-306507 | | 11/1994 |
| JP | 7-51827 | | 2/1995 |
| JP | 8-72110 | | 3/1996 |
| JP | 8-174172 | | 7/1996 |
| JP | 8-252661 | | 10/1996 |
| JP | 9-103859 | | 4/1997 |
| JP | 9-155524 | | 6/1997 |
| JP | 9-155526 | | 6/1997 |
| JP | 9-155527 | | 6/1997 |
| JP | 9-295122 | | 11/1997 |
| JP | 2001-150124 | A | 6/2001 |
| JP | 2002-137052 | A | 5/2002 |
| JP | 2002-137052 | | 5/2002 |
| JP | 2002-273564 | A | 9/2002 |
| WO | 92/13662 | | 8/1992 |
| WO | 97/21509 | | 6/1997 |
| WO | 97/45218 | | 12/1997 |
| WO | 99/28065 | | 6/1999 |
| WO | 99/50007 | | 10/1999 |

OTHER PUBLICATIONS

Mehrabian et al., "Casting in the Liquid–Solid Region," *New Trends in Materials Processing*, papers presented at a seminar of American Society for Metals, Oct. 19 and 20, 1974, ASM, Metals Park, OH, pp. 98–127.

(Continued)

*Primary Examiner*—Jonathan Johnson
*Assistant Examiner*—Len Tran
(74) *Attorney, Agent, or Firm*—Foley & Lardner LLP

(57) ABSTRACT

A vertical injection machine and method for injecting liquid metal. The machine includes a metering chamber, a vertical injection chamber, and a first conduit connecting the metering chamber to the injection chamber. The height of liquid metal in the metering chamber determines the volume of metal in the injection chamber.

25 Claims, 6 Drawing Sheets

U.S. PATENT DOCUMENTS 3,048,892 A 8/1962 Davis, Jr. et al.
3,106,002 A 10/1963 Bauer
3,123,875 A 3/1964 Madwed
3,172,174 A 3/1965 Johnson
3,189,945 A 6/1965 Strauss
3,201,836 A 8/1965 Nyselius
3,254,377 A 6/1966 Morton
3,268,960 A 8/1966 Morton
3,270,378 A 9/1966 Madwed
3,270,383 A 9/1966 Hall et al.
3,286,960 A 11/1966 Douglas et al.
3,319,702 A 5/1967 Hartwig et al.
3,344,848 A 10/1967 Hall et al.
3,447,593 A 6/1969 Nyselius et al.
3,474,854 A 10/1969 Mace
3,491,827 A 1/1970 Mace
3,529,814 A 9/1970 Werner
3,550,207 A 12/1970 Struss
3,693,702 A 9/1972 Piekenbrink et al.
3,773,873 A 11/1973 Spaak et al.
3,810,505 A 5/1974 Cross
3,814,170 A 6/1974 Kahn
3,874,207 A 4/1975 Lemelson
3,893,792 A 7/1975 Laczko
3,902,544 A 9/1975 Flemings et al.
3,936,298 A 2/1976 Mehrabian et al.
3,976,118 A 8/1976 Kahn
4,049,040 A 9/1977 Lynch
4,088,178 A 5/1978 Ueno et al.
4,168,789 A 9/1979 Deshais et al.
4,212,625 A 7/1980 Shull
4,287,935 A 9/1981 Ueno et al.
4,330,026 A 5/1982 Fink
4,347,889 A 9/1982 Komatsu et al.
4,387,834 A 6/1983 Bishop
4,434,839 A 3/1984 Vogel
4,436,140 A 3/1984 Ebisawa et al.
4,473,103 A 9/1984 Kenney et al.
4,476,912 A 10/1984 Harvill
4,510,987 A 4/1985 Collot
4,534,403 A 8/1985 Harvill
4,537,242 A 8/1985 Pryor et al.
4,559,991 A 12/1985 Motomura et al.
4,586,560 A 5/1986 Ikeya et al.
4,635,706 A 1/1987 Behrens
4,687,042 A 8/1987 Young
4,694,881 A 9/1987 Busk
4,694,882 A 9/1987 Busk
4,730,658 A 3/1988 Nakano
4,771,818 A 9/1988 Kenney
4,828,460 A 5/1989 Saito et al.
4,834,166 A 5/1989 Nakano
4,884,621 A 12/1989 Ban et al.
4,898,714 A 2/1990 Urban et al.
4,952,364 A 8/1990 Matsuda et al.
4,997,027 A 3/1991 Akimoto
5,040,589 A 8/1991 Bradley et al.
5,109,914 A 5/1992 Kidd et al.
5,143,141 A 9/1992 Frulla
5,144,998 A 9/1992 Hirai et al.
5,161,598 A 11/1992 Iwamoto et al.
5,181,551 A 1/1993 Kidd et al.
5,186,236 A 2/1993 Gabathuler et al.
5,191,929 A 3/1993 Kubota et al.
5,205,338 A 4/1993 Shimmell
5,244,033 A 9/1993 Ueno
5,375,645 A 12/1994 Brueker et al.
5,380,187 A 1/1995 Fujikawa
5,388,633 A 2/1995 Mercer, II et al.
5,394,931 A 3/1995 Shiina et al.
5,413,644 A 5/1995 Marder et al.
5,501,266 A 3/1996 Wang et al.
5,531,261 A 7/1996 Yoshida et al.
5,533,562 A 7/1996 Moschini et al.
5,571,346 A 11/1996 Bergsma
5,575,325 A 11/1996 Sugiura et al.
5,577,546 A 11/1996 Kjar et al.
5,601,136 A 2/1997 Shimmell
5,622,216 A 4/1997 Brown
5,623,984 A 4/1997 Nozaki et al.
5,630,463 A 5/1997 Shimmell
5,630,466 A 5/1997 Garat et al.
5,638,889 A 6/1997 Sugiura et al.
5,657,812 A 8/1997 Walter et al.
5,662,159 A 9/1997 Iwamoto et al.
5,664,618 A 9/1997 Kai et al.
5,665,302 A 9/1997 Benni et al.
5,680,894 A 10/1997 Kilbert
5,685,357 A 11/1997 Kato et al.
5,697,422 A 12/1997 Righi et al.
5,697,425 A 12/1997 Nanba et al.
5,701,942 A 12/1997 Adachi et al.
5,704,411 A 1/1998 Suzuki et al.
5,716,467 A 2/1998 Marder et al.
5,730,198 A 3/1998 Sircar
5,730,202 A 3/1998 Shimmell
5,735,333 A 4/1998 Nagawa
5,770,245 A 6/1998 Takizawa et al.
5,836,372 A 11/1998 Kono
5,839,497 A 11/1998 Fujino et al.
5,861,182 A 1/1999 Takizawa et al.
5,913,353 A 6/1999 Riley et al.
5,983,976 A 11/1999 Kono
6,065,526 A 5/2000 Kono
6,135,196 A 10/2000 Kono
6,241,001 B1 6/2001 Kono
6,276,434 B1 8/2001 Kono
6,283,197 B1 9/2001 Kono
6,284,167 B1 9/2001 Fujikawa
6,666,258 B1 * 12/2003 Kono ..... 164/312

OTHER PUBLICATIONS

Flemings et al., "Rheocasting," *Challenges and Opportunites in Materials Science and Engineering* (Anniversary Volume), vol. 25 (1976), Elsevier Sequoia S.A., Lausanne, pp. 103–117.

Flemings et al., "Rheocasting," *McGraw–Hill Yearbook of Science and Technology, 1977*, McGraw–Hill Book Company, NY, pp. 49–58.

Laxmanan et al., "Deformation of Semi–Solid Sn–15 Pct. Pb Alloy," *Metallurgical Transactions A*, vol. 11A: No. 12, Dec. 1980, pp. 1927–1937,.

Matsumiya et al., "Modeling of Continuous Strip Production by Rheocasting," *Metallurgical Transactions B*, vol. 12B, No. 1, Mar. 1981, pp. 17–31.

Suery et al., "Effect of Strain Rate on Deformation Behavior of Semi–Solid Dendritic Alloys," *Metallurgical Transactions A*, vol. 13A, No. 10: Oct., 1982, pp. 1809–1819.

Worthy, Ward, "Injection Molding of Magnesium Alloys," *Chemical & Engineering News*, vol. 66, No. 23, Jun. 6, 1988, pp. 29–30.

Tissier et al., "Magnesium rheocasting: a study of processing–microstructure interactions," *Journal of Materials Science*; vol. 25 (1990). Chapman and Hall Ltd., pp. 1184–1196.

Carnahan et al., "New Manufacturing Process for Metal Matrix Composite Synthesis," *Fabrication of Particulates Reinforced Metal Composites*, Proceedings of an International Conference, Montreal, Quebec, Sep. 17–29, 1990, ASM International, Metals Park, Ohio, pp. 101–105.

Flemings, "Behavior of Metal Alloys in the Semisolid State," *Metallurgical Transactions B*, vol. 22B, No. 3, Jun 1991, pp. 269–293.

Pasternak et al., "Semi–Solid Production Processing of Magnesium Alloys by Thixomolding," Proceedings of the Second International Conference on the Semi–Solid Processing of Alloys and Composites, MIT, Cambridge, MA, Jun. 10–12, 1992, TMS, Warrendale, PA, pp. 159–169.

Brown et al., "Net Shape Forming via Semi–Solid Processing," *Advanced Materials & Processes*, vol. 143, No. 1, Jan. 1993, ASM International, Metals Park, OH, pp. 36–40.

Carnanan et al., "Advances in Thixomolding," 52$^{nd}$ Annual World Magnesium Conference, Berlin, Germany, May 17–19, 1994.

Fujikawa, Misao, Conference Material, Sodick Plastech Co., Ltd., Jul. 1995, pp. 1–14.

Staff Report, "Semi–Solid Metalcasting Gains Acceptance, Applications," *Foundry Management & Technology*, Nov. 1995, Japan, pp. 23–26.

Tupari Injection Molding Machine Advertisement, Sodick Plastech Co., Ltd., May 1997.

Kalpakjian, Serope, *Manufacturing Processes for Engineering Materials*, 3rd edition, Addison Wesley Longman, Inc., Menlo Park, CA, 1997, pp. 261–263, 265–66.

* cited by examiner

VERTICAL INJECTION MACHINE USING GRAVITY FEED

FIELD OF THE INVENTION

The invention relates to a method and apparatus for manufacturing metallic parts, more particularly to a method and apparatus for manufacturing metallic parts by a process involving injection of liquid metal into a mold, including die casting methods.

BACKGROUND OF THE INVENTION

Conventional die casting apparatus are classified into cold chamber and hot chamber. In cold chamber die casting apparatus, molten metal is poured into a sleeve which is secured on a die plate and connected to an inlet opening to the mold cavity. Molten metal is injected by a plunger into the die. The molten metal in the sleeve is easily cooled down when it spreads at the bottom of the sleeve as the plunger moves forward slowly to discharge air or gas. Cooled molten metal in the sleeve forms a chilled fraction and semi-solid or solid particles. The chilled fraction and particles are injected into the molding die causing the physical properties of molded parts to be deteriorated.

Cooled molten metal increases the viscosity of the molten metal and makes it difficult to fill the mold cavity. Further, it causes blemishes on surface of a molded part. This is a serious problem particularly for magnesium alloys for which the latent heat of solidification is small (smaller than aluminum, lead and zinc). Because of the small latent heat of solidification, magnesium solidifies quickly when it comes in contact with materials having a lower temperature.

Hot sleeves have been used, but the heated sleeve is not as hot as liquidus temperature of the metal because the sleeve is connected to a molding die whose temperature has to be below the solidus temperature of the metal. The molding die temperature must be sufficiently below the solidus temperature of the molten metal to produce an adequate solidification rate. That is, a solidification rate which reflects the required time for an operation cycle. Molten metal poured into the sleeve has a substantially higher temperature than the liquidus temperature of the metal to counter the cooling in the sleeve. This is a disadvantage in energy cost for heating.

The cold chamber apparatus forms a thick round plate as a part of the casting, often called a biscuit, in the sleeve between a plunger head and an inlet of a die. After the casting is pulled away from the molding dies when the dies are opened, the biscuit is cut away from the casting and recycled. However, sometimes the biscuit is larger than the product. This is a disadvantageous use of metal which has a substantial recycling cost.

In hot chamber die casting apparatus, an injection mechanism is submerged in molten metal in a furnace. The temperature of the molten metal to be injected is maintained above its liquidus. The injection mechanism has a shot cylinder with a plunger, gooseneck chamber and a nozzle at the end of thereof. The molten metal is injected through a gooseneck-type passage and through a nozzle into the die cavity without forming a biscuit. This is an advantage of hot chamber die casting apparatus.

Another advantage of a hot chamber apparatus over a cold chamber apparatus is the time for an operation cycle. As mentioned above, in cold chamber apparatus, the casting is formed by injecting molten metal into a mold cavity between closed dies and cooling to until the casting is solid. The dies are separated and the molded part is pulled away, lubricant is sprayed onto the opened dies, and the dies are closed again. Then, the dies are ready to start the next operation cycle. The molten metal is poured into the injection sleeve when the molding dies are closed, i.e., when the dies are ready to start the next operation cycle, so that the molten metal does not spill out from the inlet opening of the die because the injection sleeve directly communicates with a die.

On the other hand, hot chamber die casting apparatus fill molten metal in the gooseneck and a shot cylinder system by returning an injection plunger to its fill up position. Molten metal is supplied through an opening or fill port on a shot cylinder. While cooling the injected molten metal in the dies, the nozzle is positioned by inclining the gooseneck chamber. The molten metal in the nozzle gooseneck system tends to flow back into the furnace through the fill port on the shot sleeve, reaching a hydrostatic level when the dies are opened. By simultaneously filling molten metal into the gooseneck and a shot cylinder system and cooling injected metal in the closed dies, time for an operation cycle of the hot chamber apparatus is shortened compared with the cold chamber die casting apparatus.

However, solidification of the molten metal in the nozzle section of the gooseneck and dripping of molten metal from the nozzle and the cast sprue are problems for hot chamber die casting apparatus. It is known that in hot chamber die casting apparatus a vacuum is created in the injection mechanism when the plunger is withdrawn. However, the vacuum is instantaneously destroyed once the plunger passes the opening or fill port on the shot cylinder supplying molten metal from the furnace because the furnace is at atmospheric pressure. Thus, the molten metal is sucked into the shot cylinder, and the gooseneck and the nozzle are completely filled at the time that the casting is solidified and the dies are separated.

There is molten metal in the nozzle for most of the time that the casting is cooling. When the cooling at the tip of the nozzle is properly controlled, it is understood in the industry that the metal in the nozzle tip becomes semi-solid. The formed semi-solid metal works as a plug which prevents molten metal from dripping out of the nozzle when the dies are separated. If the cooling is insufficient, the metal in the tip of the nozzle and the cast sprue is still liquid when the dies are separated and dripping occurs. On the other hand, when too much cooling is applied, the metal in the nozzle tip solidifies and freezes together with the cast sprue. The casting will stick in the stationary die after the dies open.

U.S. Pat. Nos. 3,123,875, 3,172,174, 3,270,378, 3,474,875 and 3,491,827 propose creating a vacuum in the gooseneck by return or reverse stroke of the plunger to draw back molten metal from the nozzle and extreme tip of the sprue. These patents disclose mechanisms attached to the shot cylinder and a plunger system so that the created vacuum is kept intact until after the dies have been separated and the solidified casting has been withdrawn from the sprue opening of the stationary die.

Problems in the hot chamber die casting apparatus are caused because a heavy injection mechanism is submerged in the molten metal in the furnace. The injection mechanism with a gooseneck chamber and a shot cylinder system is difficult to clean up. It is also difficult to replace worn plunger rings and sleeves. A worn plunger ring and sleeve decreases injection pressure due to leakage and makes shot volume inconsistent in filling the mold cavity. The inconsistent shot volume produces inconsistent molded parts.

Die casting apparatus are also classified according to the arrangement of the injection system, that is, horizontal and vertical. In a horizontal die casting apparatus, an injection system is horizontally arranged for horizontally injecting molten metal into molding dies. A vertical die casting apparatus has a vertically arranged injection system for vertical injection of molten metal.

Conventional vertical die casting apparatus typically are vertically arranged cold chamber apparatus that have the same advantages and disadvantages of the cold chamber apparatus described above. However, a feature of the vertical die casting apparatus is that the inlet opening for molten metal can be on top of the vertical injection chamber. This arrangement is not applicable to the horizontally arranged apparatus. In U.S. Pat. Nos. 4,088,178 and 4,287,935, Ube discloses machines in which a vertical casting sleeve is pivotally mounted to a base and slants from perpendicular position to accept molten metal. In place of supplying molten metal to the casting sleeve, Nissan Motors discloses in U.S. Pat. No. 4,347,889 a vertical die casting machine in which a vertical casting sleeve moves downward and a solid metal block is inserted. The inserted metal block is melted in the sleeve by an high frequency induction coil. The problem with these apparatus is the complexity of their structure.

SUMMARY OF THE INVENTION

One embodiment of the present invention includes a vertical injection machine for injecting liquid metal comprising a metering chamber; a vertical injection chamber; and a first conduit connecting the metering chamber to the injection chamber, wherein a height of liquid metal in the metering chamber determines a volume of metal in the injection chamber.

Another embodiment of the invention includes a method of injection molding comprising melting metal into a liquid state in a metering chamber; retracting an injection rod in a vertical injection chamber to expose an opening in the vertical injection chamber; allowing a portion of liquid metal to flow from the metering chamber into the vertical injection chamber via a conduit, wherein a volume of the portion of the liquid metal in the injection chamber is determined by a height of liquid metal in the metering chamber; advancing the injection rod to close the opening and drive off air in the injection chamber; elevating the injection chamber towards a stationary mold; and advancing the injection rod to inject the portion of liquid metal from the injection chamber through a nozzle into the mold.

Another embodiment of the invention includes a method of injection molding comprising melting metal into a liquid state in a melt feeder; passing a first portion of liquid metal to a metering chamber via a first conduit; retracting an injection rod in a vertical injection chamber to expose an opening in the vertical injection chamber; allowing a second portion of liquid metal to flow from the metering chamber into the vertical injection chamber via a second conduit, wherein a volume of the second portion of the liquid metal in the injection chamber is determined by a height of liquid metal in the metering chamber; advancing the injection rod to close the opening; elevating the injection chamber towards a stationary mold; and advancing the injection rod to inject the second portion of liquid metal from the injection chamber through a nozzle into the mold.

BRIEF DESCRIPTION OF THE DRAWINGS

The foregoing and other features, aspects and advantages of the present invention will become apparent from the following description, appended claims and the exemplary embodiments shown in the drawings, which are briefly described below. It should be noted that unless otherwise specified like elements have the same reference numbers.

DETAILED DESCRIPTION OF THE PREFERRED EMBODIMENTS

The present inventors have discovered an improved machine for manufacturing molded metallic parts that is capable of accurately metering metal. The machine includes a metering chamber in which the height of the molten metal in the chamber determines the amount of metal entering the injection chamber. Because the height of the molten metal in the metering chamber can be accurately determined, the amount of metal in the metering chamber can be accurately determined. This results in an injection device with improved metering capability over conventional injection molding machines.

Figure 1:
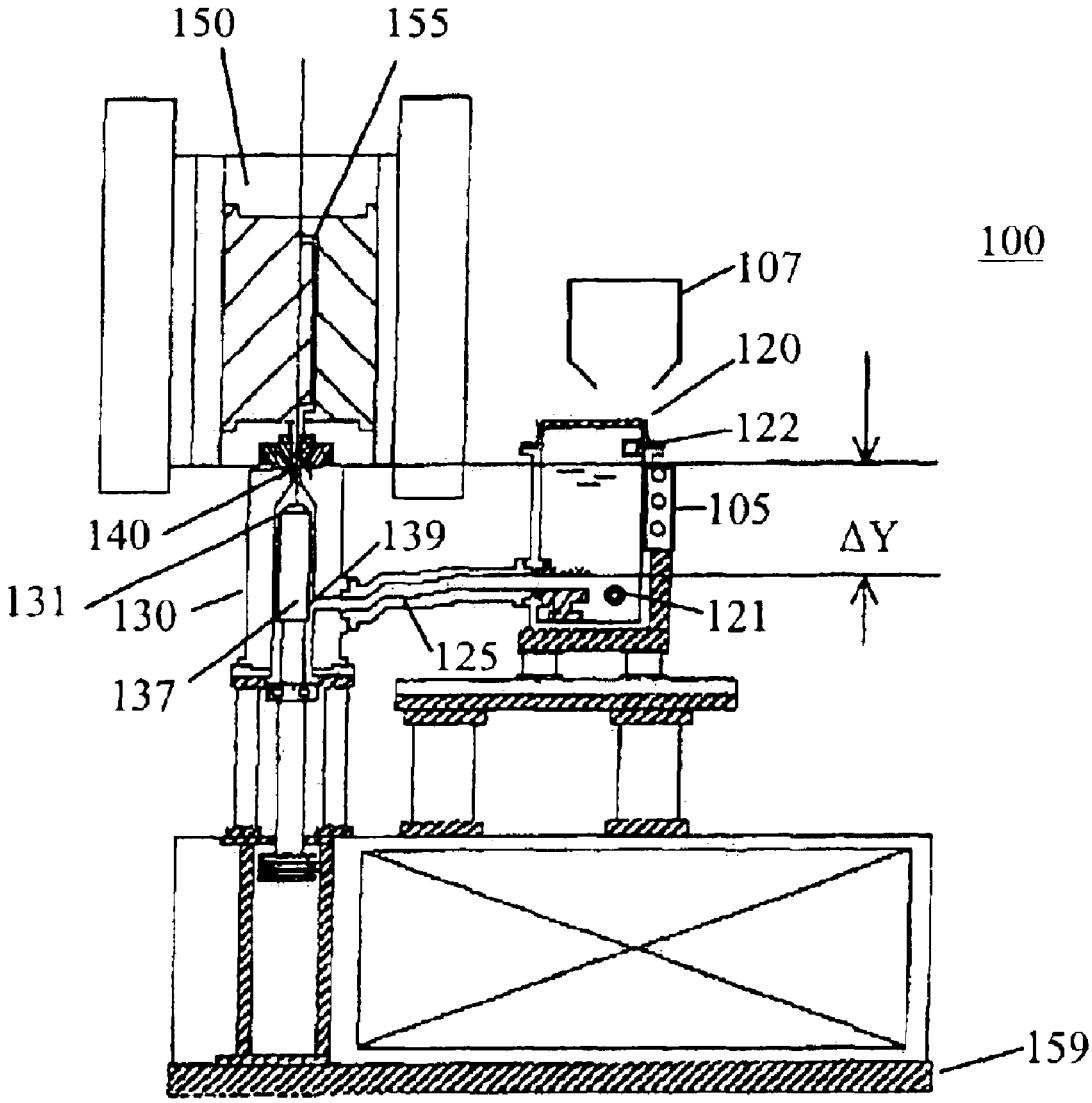
FIG. 1 is schematic diagram of a multichamber vertical injection machine according to one embodiment of the invention.
Figure 2:
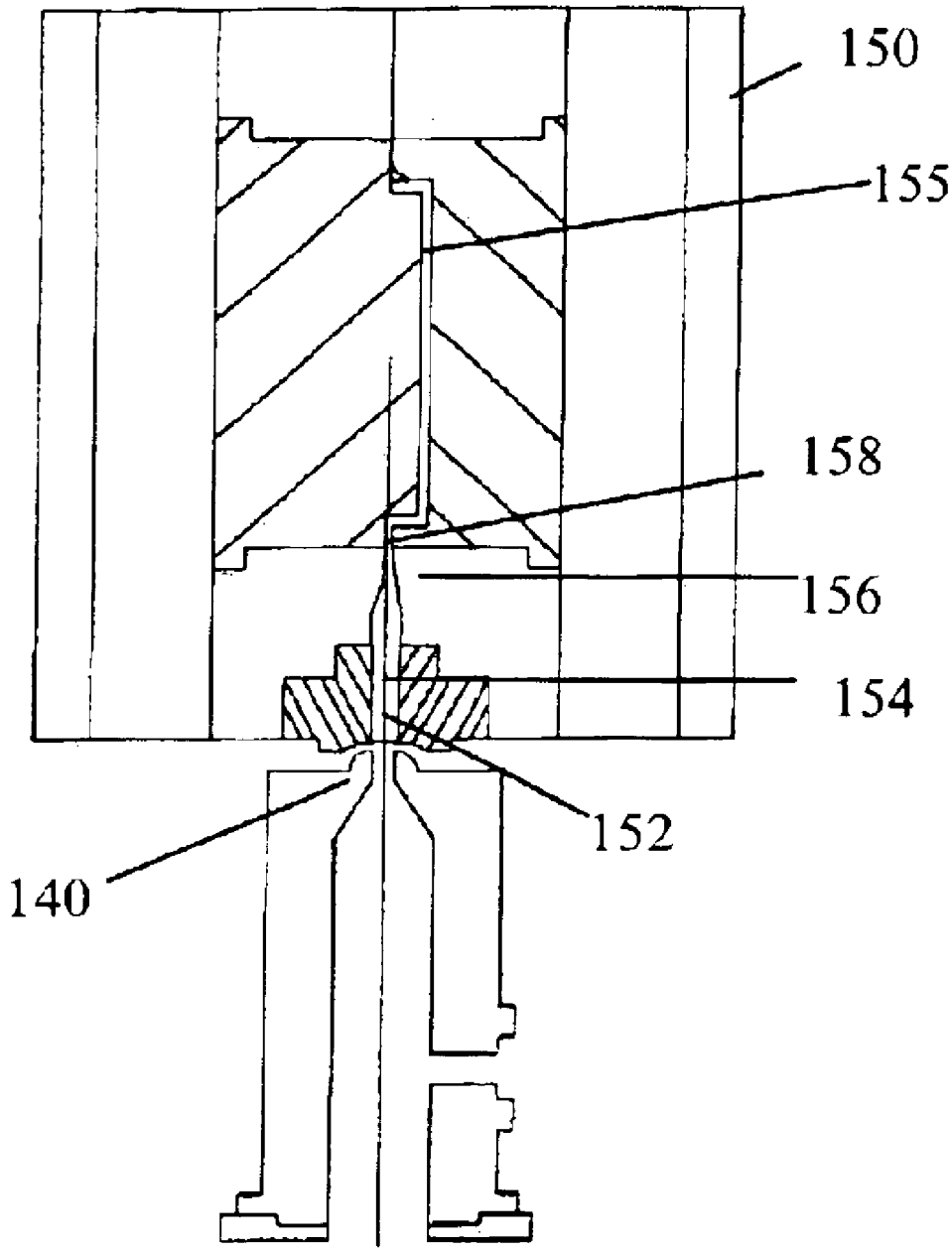
FIG. 2 is a detailed view of a portion of the multichamber vertical injection machine of FIG. 1.

FIGS. 1 and 2 illustrate one embodiment of the invention. The injection machine 100 of this embodiment includes a metering chamber 120 in which solid metal is charged from a solid metal feed source 107. The solid metal may be ingot, pellet, powder or any other suitable metal source. The solid metal feed source 107 may include a hopper, an ingot suspended by a wire, a conveyor belt, a technician hand feeding solid metal or any other suitable method for feeding solid metal. Preferably, adjacent to the metering chamber 120 is at least one heating source 105 which provides sufficient heat to liquefy the metal.

Also in a preferred embodiment of the invention, the metering chamber 120 includes a sensor 122 and a liquid metal adjustment device 121. In the one embodiment of the invention, the sensor 122 detects the height of the liquid metal in the metering chamber 120. The sensor 122 is connected to a control unit (not shown) such as a computer processor or an operator manning a control panel. In this embodiment, the length and width of the metering chamber 120 are precisely known. Thus, the volume metal for a given height in the metering chamber 120 is easily determined. If the height of the liquid metal in the metering chamber 120 exceeds the height necessary for injection of a particular part, the liquid metal adjustment device 121 can be opened by the control unit or manually to allow excess liquid metal out of the metering chamber 120.

Figure 3A:
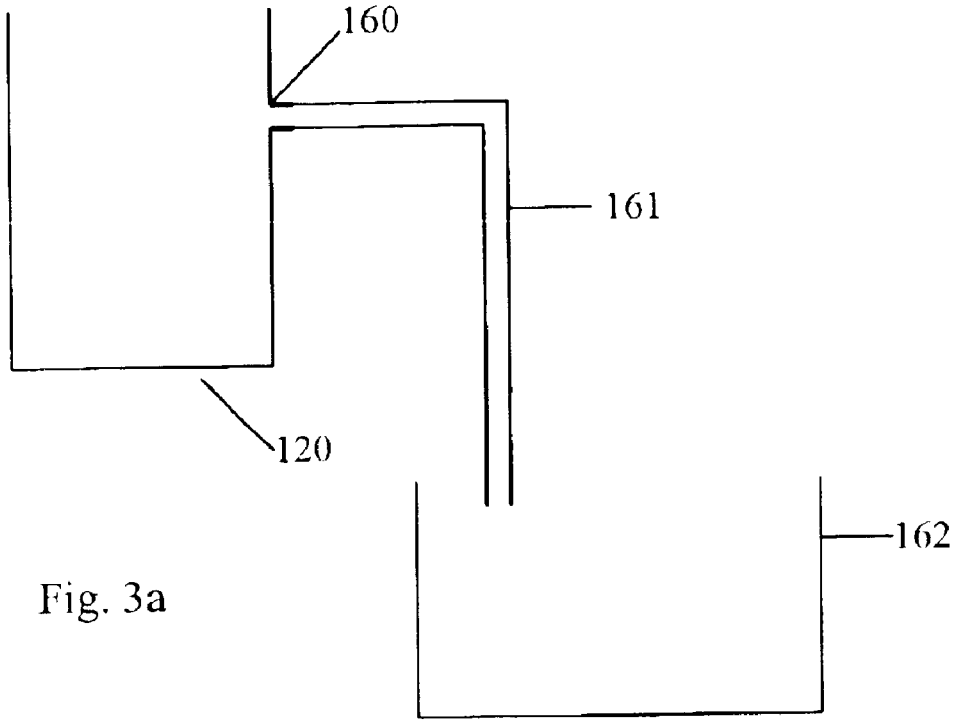
FIGS. 3*a–c* illustrate liquid metal adjustment devices according to embodiments of the invention including (a) one recycle port, (b) series of recycle ports and (c) a reciprocating adjustment device.

In one embodiment of the invention, illustrated in FIG. 3*a,* the liquid metal adjustment device 121 is a recycle port 160 in a side of the metering chamber 120 at a predetermined height. The height is determined such that the proper volume of metal for casting remains in the metering chamber 120. In this embodiment, it is unnecessary to have a sensor 122. Preferably, attached to the recycle port 160 is a recycle conduit 161 which returns excess liquid metal to a recycle container 162.

Figure 3B:
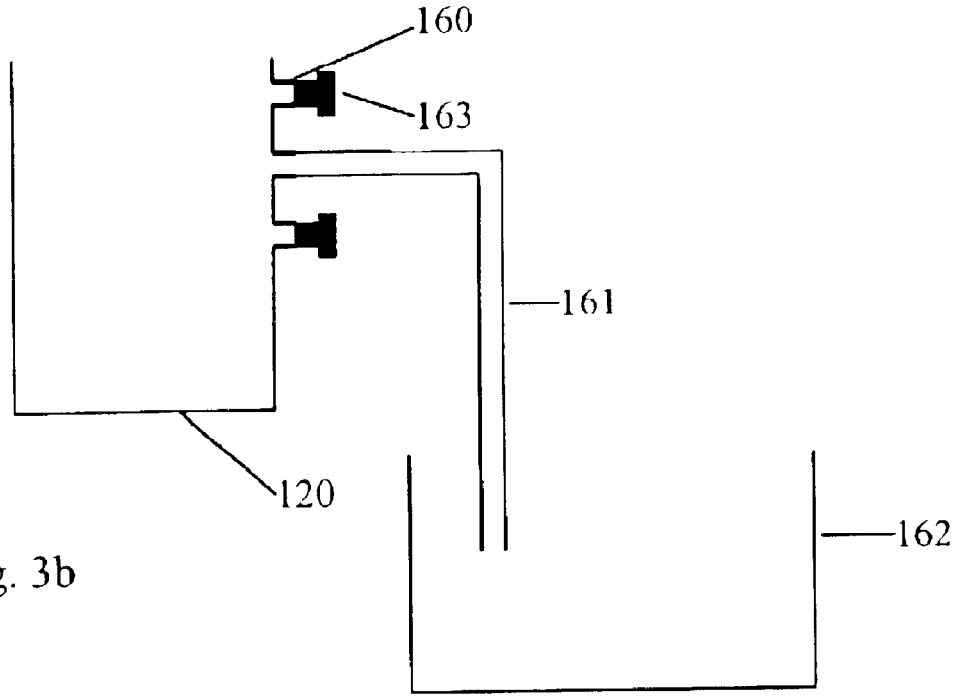

FIG. 3*b* illustrates another aspect of the invention. In this aspect, the liquid metal adjustment device 121 comprises a series of recycle ports 160 at predetermined heights along a side of the metering chamber 120. In this embodiment, all of the recycle ports 160 are plugged with caps, valves or similar devices 163 except for the one port 160 for which the proper volume of metal for casting remains in the metering chamber 120. Preferably, as in the previous embodiment, a recycle conduit 161 is attached to the recycle ports 160 to return excess liquid metal to a recycle container 162.

Figure 3C:
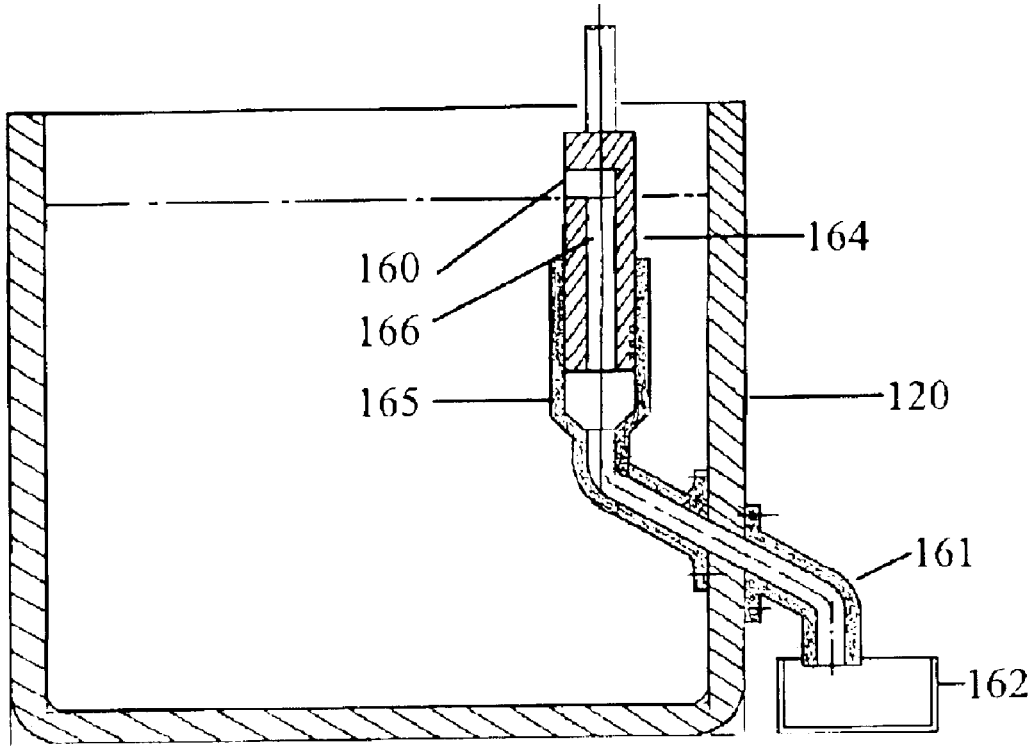

FIG. 3*c* illustrates another aspect of the invention. In this aspect, the liquid metal adjustment device 121 is located inside the metering chamber 120. The device 121 comprises a recycle port 160 connected to a channel 166 within a sliding member 164. The sliding member 164 is located in a stationary member 165 attached to a wall of the metering chamber 120. The desired height of liquid metal in the metering chamber 120 can be easily set by raising or lowering the sliding member 164, which raises or lowers the recycle port 160 to collect overflow, excess liquid metal. Preferably, as in the previous embodiments, a recycle conduit 161 is connected to the adjustment device 121 to return excess liquid metal to a recycle container 162. The sliding member 164 and the stationary member 165 may have any suitable configuration. For example, the sliding member may be cylinder which slides on the inside surface of a cylindrical the stationary member, as shown in FIG. 3*c*. Alternatively, the sliding member 164 may be wider than the stationary member 165, and the sliding member may slide over the outside surface of the stationary member. The sliding and stationary members may have shapes other than cylindrical shapes, such as polygonal or other shapes. Furthermore, the recycle port 160 may be located in the upper rather than in the side surface of the sliding member 164.

The metering chamber 120 is connected to an injection chamber 130 via a conduit 125, where the injection chamber and the conduit have heating sources and insulation, not shown, which provide sufficient heat to keep the metal liquid. Specifically, the conduit 125 connects to an opening 139 in a side wall of the injection chamber 130, the injection chamber being vertically oriented. At the upper end of the injection chamber 130 is an injection nozzle 140. At the lower end of the injection chamber 130 is a injection rod 137. Preferably, the front face 131 of the injection rod 137 is substantially flat. However, the front face 131 of the injection rod 137 may have beveled edges.

In a preferred embodiment of the invention, the injection machine 100 is mounted on a lifting base 159. The lifting base 159 is configured to lift the entire injection machine 100 toward a stationary mold 150 having a mold cavity 155. Alternatively, the injection machine 100 could be held stationary and the mold 150 could be configured to move relative to the injection machine 100.

When operating the injection machine 100 according to a first preferred method, solid metal is charged into the metering chamber 120. The solid metal is held in the metering chamber 120 until it is liquid. In this embodiment of the invention, the height of the liquid metal in the metering chamber 120 determines the amount of metal that flows into the injection chamber 130. If the sensor 122 detects that the amount of liquid metal in the metering chamber 120 is insufficient, more solid metal is added. However, if the sensor 122 detects that the metering chamber 120 contains an excess of liquid metal, the liquid metal adjustment device 121 is opened manually or automatically by the control unit to allow excess liquid metal out of the metering chamber 120.

When it is determined that the proper amount of liquid metal is in the metering chamber 120, the injection rod 137 in the injection chamber 130 is retracted from an upper position to a lower position to expose an opening 139 in the injection chamber 130. This allows metal in the conduit 125 to flow into the injection chamber 130. The liquid metal flows into the injection chamber 130 due to gravity alone. This is because the height of the metal in the metering chamber 120 is higher than the opening 139 in the injection chamber 130 ($\Delta Y$ in FIG. 1). Thus, the metering chamber 120 is positioned laterally from the injection chamber 130 at a height such that the desired metal fill level in the metering chamber 120 is at the same height as the fill level in the injection chamber 130 after the two chambers 120, 130 are connected through the conduit 125 and the opening 139.

When the injection chamber 130 is filled, that is, when the desired amount of liquid metal for injection is in the injection chamber 130, the injection rod 137 is slowly advanced to close the opening 139 in the injection chamber 130 and to drive off any air which is in the injection chamber 130. Then, in a preferred embodiment of the invention, the entire injection machine 100 is lifted toward the mold 150 until the injection nozzle 140 abuts the mold 150.

The injection rod 137 is advanced upward at a second rate faster than the first rate, forcing liquid metal into the mold 150. In a preferred embodiment of the invention, the mold 150 has an inverted sprue 154 having a roughly funnel shape with the large opening 152 facing the injection nozzle 140 and the small opening 156 connecting to a gate 158 (FIG. 2). The injection machine 100 remains in the upper position until the casting and the gate 158 solidify. Then the injection rod 137 is lowered quickly for a distance. Any molten or semi-solid metal remaining in the sprue 154 and the nozzle tip 140 is sucked back into the injection chamber 130. In this manner of operation, no solid plug is formed in the injection nozzle 140, and the metal remains in the liquid state in the nozzle throughout the entire cycle.

Finally, the injection machine 100 is lowered. At the same time, the mold 150 is opened and the casting is removed. Additionally, the dies which comprise the mold 150 are lubricated for the next casting.

Figure 4:
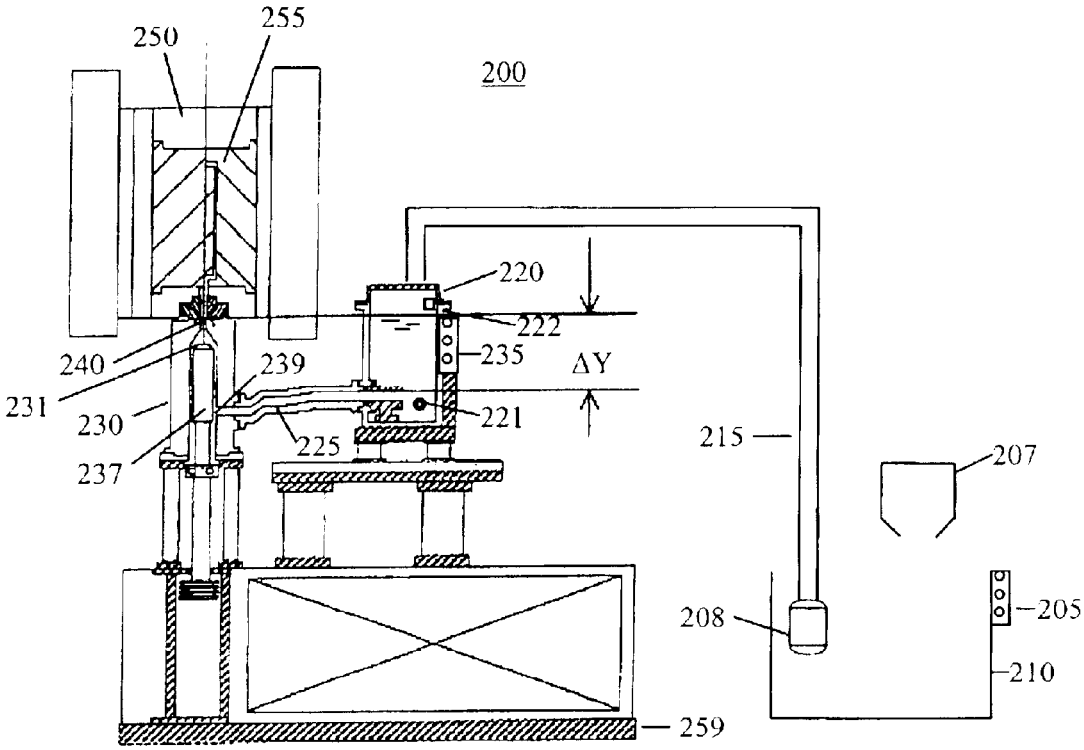
FIG. 4 is schematic diagram of a multichamber vertical injection machine according to another embodiment of the invention.
Figure 5:
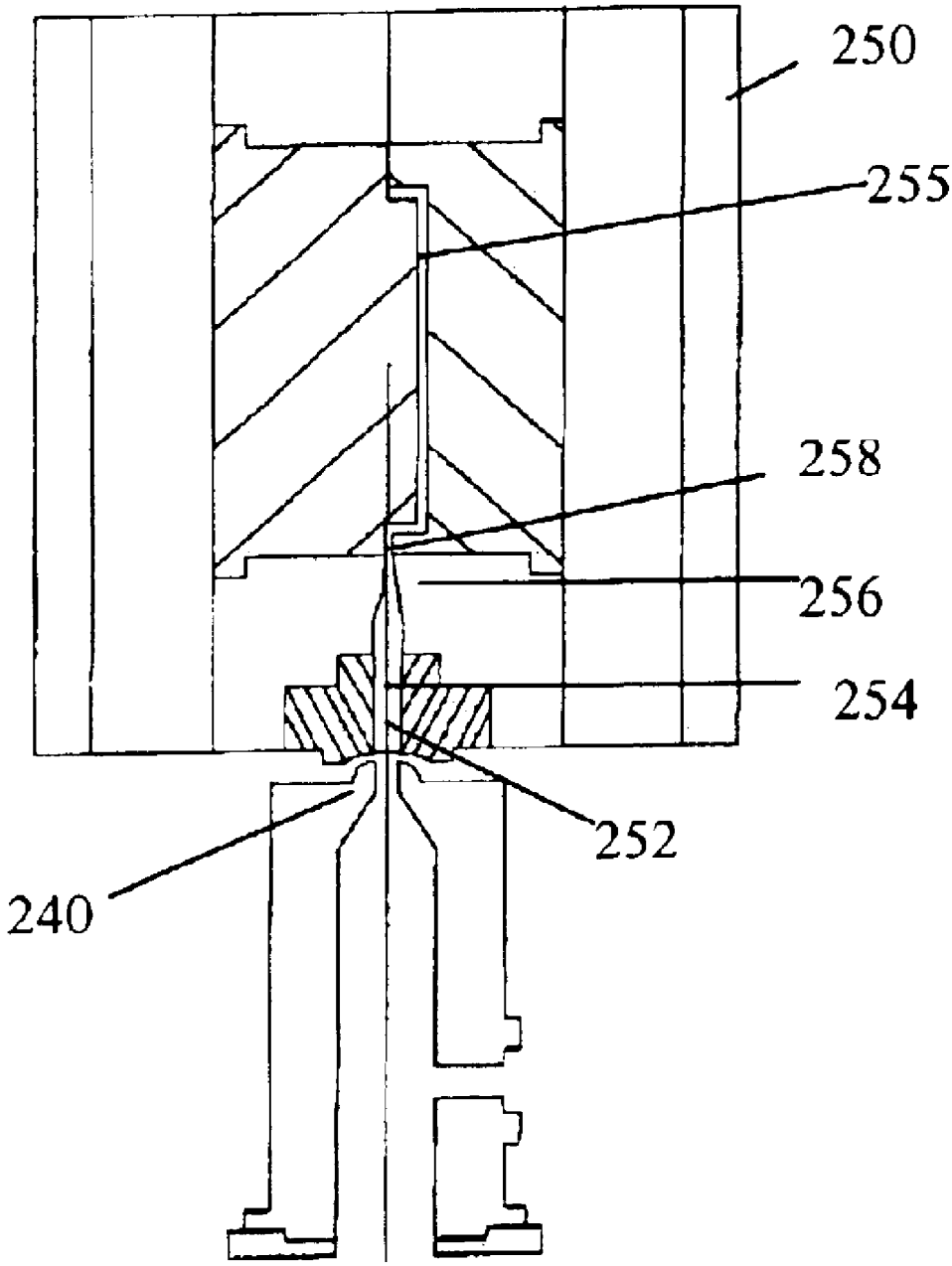
FIG. 5 is a detailed view of a portion of the multichamber vertical injection machine of FIG. 4.

FIGS. 4 and 5 illustrates another embodiment of the invention. The injection machine 200 of this embodiment includes a melt furnace 210 in which solid metal is charged from a solid metal feed source 207. The solid metal may be ingot, pellet, powder or any other suitable metal source. The solid metal feed source 207 may include a hopper, an ingot suspended by a wire, a conveyor belt, a technician hand feeding solid metal or any other suitable method for feeding solid metal. The melt furnace 210 includes a heating source 205 which provides sufficient heat to liquefy the metal. Additionally, a pump 208 is located in the melt furnace 210. The pump 208 may be a plunger pump or another suitable type of pump which can pump metal through a conduit.

A metering chamber 220 is located separately, and preferably but not necessarily, above the melt furnace 210. A first conduit 215, equipped with a heating source to provide sufficient heat to keep the metal liquid, connects the melt furnace 210 and the metering chamber 220. Specifically, one end of the first conduit 215 is connected to the pump 208 in the melt furnace 210. The other end is connected to an upper portion of the metering chamber 220. At least one heating source 235 is located adjacent to the metering chamber 220 and maintains the metal in the liquid state.

Also in a preferred embodiment of the invention, the metering chamber 220 includes a sensor 222 and a liquid metal adjustment device 221. In the one embodiment of the invention, the sensor 222 detects the height of the liquid metal in the metering chamber 220. The sensor 222 is connected to a control unit (not shown) such as a computer processor or an operator manning a control panel. In this embodiment, the length and width of the metering chamber 220 are precisely known. Thus, the volume metal at a given height in the metering chamber 220 is easily determined. If the height of the liquid metal in the metering chamber 220 exceeds the height necessary for injection of a particular part, the liquid metal adjustment device 221 can be opened by the control unit or manually to allow excess liquid metal out of the metering chamber 220. Rather than measure the height of the liquid metal, another embodiment of the invention uses a sensor 222 which measures the flow of metal into the metering chamber 220 from the melt furnace 210.

As in earlier embodiments of the invention, the adjustment device 221 may include a single recycle port 160, a series of recycle ports 160 or a recycle port in a slidable member 164 (see FIGS. 3*a*–3*c*). Preferably, the recycle ports 160 are connected to a recycle container 162 or the melt furnace 210 with a recycle conduit 161 to facilitate recycling of excess liquid metal removed from the metering chamber 220.

The second conduit 225 connects to an opening 239 in a side wall of the injection chamber 230, the injection chamber being vertically oriented. The second conduit 225 and the injection chamber 220 also have heating sources, not shown, which provide sufficient heat to keep the metal liquid. At the upper end of the injection chamber 230 is an injection nozzle 240. At the lower end of the injection chamber 230 is a injection rod 237. Preferably, the front face 231 of the injection rod 237 is substantially flat. However, the front face 231 of the injection rod 237 may have beveled edges.

In a preferred embodiment of the invention, the injection machine 200 is mounted on a lifting base 259. The lifting base 259 is configured to lift the entire injection machine 200 toward a stationary mold 250 having a mold cavity 255. Alternatively, the injection machine 200 could be held stationary and the mold 250 could be configured to move relative to the injection machine 200.

When operating the injection machine 200 according a second preferred method, solid metal is charged into the melt furnace 210 from a solid metal feed source 207. The solid metal is heated by heating source 205 until it is liquefied. A first portion of liquid metal is then pumped from the melt chamber 210 to the metering chamber 220 via the first conduit 215 by pump 208.

In this embodiment of the invention, the height of the liquid metal in the metering chamber 220 determines the amount of metal that flows into the injection chamber 230. If the sensor 222 detects that the amount of liquid metal in the metering chamber 220 is insufficient, more liquid metal is pumped to the metering chamber 220. However, if the sensor 222 detects that the metering chamber 220 contains an excess of liquid metal, the liquid metal adjustment device 221 is opened to allow excess liquid metal out of the metering chamber 220. Preferably, the pump 208 and the sensor 222 are connected to the same controller which controls the pump operation to provide a desired amount of liquid metal into the metering chamber 220. The pump operation may be controlled automatically by a computer and/or by an operator using a control panel.

In an alternative embodiment, no sensor 222 is provided in the metering chamber 220. Rather, the pump 208 is operated to provide an exact of mount of liquid metal to the metering chamber 220.

When it is determined that the proper amount of liquid metal is in the metering chamber 220 (a second portion which is typically the same as the first portion but may vary if the first portion required adjustment), the injection rod 237 in the injection chamber 230 is retracted from an upper position to expose the opening 239 in the injection chamber 230. This allows metal in the second conduit 225 to flow into the injection chamber 230. The liquid metal flows into the injection chamber 230 due to gravity alone. This is because the height of the metal in the metering chamber 220 is higher than the opening 239 in the injection chamber 230 ($\Delta Y$ in FIG. 4). Thus, the metering chamber 220 is positioned laterally from the injection chamber 230 at a height such that the desired metal fill level in the metering chamber 220 is at the same height as the fill level in the injection chamber 230 after the two chambers 220, 230 are connected through the conduit 225 and the opening 239.

When the injection chamber 230 is filled, that is, when the desired amount of liquid metal for injection is in the injection chamber 230, the injection rod 237 is slowly advanced to close the opening 239 in the injection chamber 230 and to drive off any air which is in the injection chamber 230. Then, in a preferred embodiment of the invention, the entire injection machine 200 is lifted toward the mold 250 until the injection nozzle 240 abuts the mold 250.

The injection rod 237 is advanced, forcing liquid metal across the gap into the mold 250. In a preferred embodiment of the invention, the mold 250 has an inverted sprue 254 having a roughly funnel shape with the large opening 252 facing the injection nozzle 240 and the small opening 256 connecting to a gate 258 (FIG. 5). The injection machine 200 remains in the upper position until the casting and the gate 258 solidify. Then the injection rod 237 is lowered. Any molten or semi-solid metal remaining in the sprue 254 and the nozzle tip 240 is sucked back into the injection chamber 230. In this manner of operation, no solid plug is formed in the injection nozzle 240, and the metal remains in the liquid state in the nozzle throughout the entire cycle.

Finally, the injection machine 200 is lowered. At the same time, the mold 250 is opened and the casting is removed. Additionally, the dies which comprise the mold 250 are lubricated for the next casting. The injection machines 100, 200 preferably inject magnesium and magnesium alloys. However, the machines 100, 200 can be used to inject other metals, such as aluminum, zinc, lead alloys or non-ferrous materials containing reinforcing material such as ceramics.

The foregoing description of the invention has been presented for purposes of illustration and description. It is not intended to be exhaustive or to limit the invention to the precise form disclosed, and modifications and variations are possible in light of the above teachings or may be acquired from practice of the invention. The drawings and description were chosen in order to explain the principles of the invention and its practical application. It is intended that the scope of the invention be defined by the claims appended hereto, and their equivalents.

What is claimed is:

1. A vertical injection machine for injecting liquid metal comprising:

a metering chamber;

a liquid metal adjustment device comprising at least one recycle port located in the metering chamber;

a vertical injection chamber; and a first conduit connecting the metering chamber to the injection chamber, wherein a height of liquid metal in the metering chamber determines a volume of metal in the injection chamber.

2. The vertical injection machine of claim 1, further comprising a solid metal feed source for feeding solid metal to the metering chamber.

3. The vertical injection machine of claim 2, wherein the solid metal feed source includes a hopper, an ingot suspended by a wire, a conveyor belt or hand fed solid metal.

4. The vertical injection machine of claim 1, further comprising at least one heater adjacent to the metering chamber.

5. The vertical injection machine of claim 1, further comprising a slidable member having the at least one recycle port therein.

6. The vertical injection machine of claim 1, further comprising a recycle conduit having one end fluidly connected to the at least one recycle port and the other end fluidly connected to a recycle container.

7. The vertical injection machine of claim 1, further comprising a level sensor located in the metering chamber to determine the amount of metal in the metering chamber.

8. The vertical injection machine of claim 1, further comprising an injection rod in the injection chamber, the injection rod adapted to cover a feed hole from the first conduit into the injection chamber when the injection rod is in an upper position and to uncover the feed hole when in a lower position, such that the height of liquid metal in the metering chamber determines a volume of metal in the injection chamber when the feed hole is uncovered.

9. The vertical injection machine for injecting liquid metal comprising:

a metering chamber;

a vertical injection chamber;

a first conduit connecting the metering chamber to the injection chamber;

an injection rod in the injection chamber, the injection rod adapted to cover a feed hole from the first conduit into the injection chamber when the injection rod is in an upper position and to uncover the feed hole when in a lower position, such that a height of liquid metal in the metering chamber determines a volume of metal in the injection chamber when the feed hole is uncovered; and a base adapted to lift the injection chamber and the metering chamber toward a stationary mold.

10. The vertical injection machine of claim 9, further comprising an injection nozzle in a top portion of the injection chamber.

11. The vertical injection machine of claim 1, further comprising a melt feeder and a second conduit, the second conduit connecting the melt feeder to the metering chamber.

12. The vertical injection machine of claim 11, further comprising at least one heater adjacent to the melt feeder.

13. The vertical injection machine of claim 11, wherein the melt feeder is located at a level below the metering chamber.

14. The vertical injection machine of claim 11, further comprising a pump attached to the second conduit and adapted to pump liquid metal from the melt feeder to the metering chamber.

15. A vertical injection machine for injecting liquid metal comprising:

a vertical injection chamber;

a metering means for determining a volume of liquid metal in the injection chamber by a height of the liquid metal in the metering means;

a lifting means for lifting the injection chamber and the metering means toward a stationary mold; and a connecting means for providing the liquid metal from the metering means to the injection chamber.

16. The vertical injection machine of claim 15, further comprising an injection means for injecting liquid metal from the injection chamber into a mold.

17. The vertical injection machine of claim 15, wherein the injection means is a means for covering a feed hole from the connecting means into the injection chamber when the injection means is in an upper position and for uncovering the feed hole when in a lower position, such that the height of liquid metal in the metering means determines a volume of metal in the injection chamber when the feed hole is uncovered.

18. The vertical injection machine of claim 17, wherein the metering means is laterally spaced apart from the injection chamber such that a metal fill level in the metering means is at the same height as a metal fill level in the injection chamber when the injection means in the injection chamber is located below the feed hole.

19. The vertical injection machine of claim 15, further comprising an injection nozzle in a top portion of the injection chamber.

20. The vertical injection machine of claim 15, further comprising a means for providing metal into the metering means.

21. The vertical injection machine of claim 15, wherein the connecting means is a means for allowing the liquid metal to flow from the metering means to the injection chamber by gravity alone.

22. The vertical injection machine of claim 1, wherein the metering chamber is laterally spaced apart from the injection chamber such that a metal fill level in the metering chamber is at the same height as a metal fill level in the injection chamber when an injection rod in the injection chamber is located below a feed hole from the first conduit into the injection chamber.

23. The vertical injection machine of claim 1, further comprising a base adapted to lift the injection chamber and the metering chamber toward a stationary mold.

24. The vertical injection machine of claim 9, further comprising a solid metal feed source for feeding solid metal to the metering chamber.

25. The vertical injection machine of claim 9, further comprising a melt feeder and a second conduit, the second conduit connecting the melt feeder to the metering chamber.

* * * * *